US007642721B2

(12) United States Patent
Nagahara et al.

(10) Patent No.: US 7,642,721 B2
(45) Date of Patent: Jan. 5, 2010

(54) HIGH PRESSURE DISCHARGE LAMP

(75) Inventors: Toshiyuki Nagahara, Tokyo (JP); Shinya Omori, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 245 days.

(21) Appl. No.: 11/695,709

(22) Filed: Apr. 3, 2007

(65) Prior Publication Data

US 2007/0228983 A1 Oct. 4, 2007

(30) Foreign Application Priority Data

Apr. 3, 2006 (JP) ..... 2006-101899

(51) Int. Cl.
*H01J 17/04* (2006.01)

(52) U.S. Cl. ..... 313/631; 313/491

(58) Field of Classification Search ..... 313/25, 313/491, 493, 631, 634
See application file for complete search history.

(56) References Cited

U.S. PATENT DOCUMENTS 6,624,580 B2 * 9/2003 Kanegae et al. ..... 315/56

FOREIGN PATENT DOCUMENTS

JP 2002304968 10/2002

* cited by examiner

*Primary Examiner*—Vip Patel
(74) *Attorney, Agent, or Firm*—Cermak Kenealy Vaidya & Nakajima LLP

(57) ABSTRACT

A high pressure discharge lamp can be used in a vehicle lighting device as a light source in place of a halogen lamp, and can be driven with a reduced starting voltage while being miniaturized. A gas is filled in a space between an arc tube and an outer tube of the high pressure discharge lamp, the gas being capable of dielectric barrier discharge, to reduce the starting voltage. A metal conductor is arranged in the space between the arc tube and the outer tube to stabilize the starting voltage and perform other functions. The metal conductor can also serve as a lead line. Accordingly, high voltage portions of the lamp are not exposed outside of the outer tube. This can reduce the entire size of the high pressure discharge lamp such that a housing for a headlight using a halogen lamp can be used for this type of high pressure discharge lamp.

22 Claims, 3 Drawing Sheets

HIGH PRESSURE DISCHARGE LAMP

This application claims the priority benefit under 35 U.S.C. § 119 of Japanese Patent Application No. 2006-101899 filed on Apr. 3, 2006, which is hereby incorporated in its entirety by reference.

BACKGROUND

1. Technical Field

The presently disclosed subject matter relates to a high pressure discharge lamp, and in particular, to a high pressure discharge lamp for use in a vehicle lighting device as a light source in place of a halogen lamp, for example. The high pressure discharge lamp made in accordance with principles of the disclosed subject matter can be driven with a decreased starting voltage and can miniaturize the entire lamp device.

2. Description of the Related Art

FIG. 1 shows the configuration of a conventional high pressure discharge lamp 90 of this type. The high pressure discharge lamp 90 is configured to include an arc tube 91 and an outer tube 92 surrounding the arc tube 91. The arc tube 91 has a discharge space 91*b* containing a rare gas sealed thereinside, and a pair of discharge electrodes 91*a* projecting into the discharge space 91*b* and arranged oppositely relative to each other. In the space 95 formed between the arc tube 91 and the outer tube 92, a gas 93 capable of dielectric barrier discharge is sealed.

Examples of such a gas 93 capable of dielectric barrier discharge include Ne, Ar, Kr, Xe, $F_2$, $Cl_2$, $Br_2$, $I_2$, $N_2$, and mixtures thereof.

A description will now be given regarding the start operation (light-up operation) of the conventional high pressure discharge lamp 90. First, a starting pulse is applied between the paired discharge electrodes 91*a* that project into the discharge space 91*b* of the arc tube 91. At the same time, an electric field is also applied to the space 95 from current feeding conductors 94*a* and 94*b* buried in the respective sealing portions of the arc tube 91 by way of the sealing portions which can be made of a dielectric such as quartz glass.

As pointed out above, the space 95 contains a gas 93 that is apt to produce dielectric barrier discharges. If the starting voltage of dielectric barrier discharge is lower than the discharge starting voltage for the arc tube 91, dielectric barrier discharge starts in the space 95 between the arc tube 91 and the outer tube 92 before the electric discharge starts in the discharge space 91*b*. The starting voltage of dielectric barrier discharge between the arc tube 91 and the space 95 is typically as low as a few kilovolts (kV).

As the dielectric barrier discharge occurs, light having wavelengths corresponding to the type of gas sealed in the space 95 reaches the paired discharge electrodes 91*a*. Due to photoelectric effect, electrons are generated to induce an electron avalanche, thereby generating a discharge path inside the discharge space 91*b*. This reduces the starting voltage to a few kilovolts (kV) which otherwise is approximately 20 kV for starting such a typical high pressure discharge lamp. It should be noted that the reference numeral 96 denotes a lead line for connecting the discharge electrode to a power source, 97 denotes a ceramic pipe for protecting the lead line, 98 denotes a socket, and 99 denotes a light shielding cover by means of a black opaque coating applied onto the surface of the outer tube 92 for serving as a part of a light distribution forming means. (See, for example, Japanese Patent Laid-Open Publication No. 2002-304968 and English Abstract, which are hereby incorporated in their entireties by reference.)

The above-described conventional high pressure discharge lamp 90 has a shape of a so-called double end type, and a lead line 96 is provided for applying a high voltage from the tip end side of the outer tube 92. When a hood (not shown) is attached to the system using this type of high pressure discharge lamp 90 in order to shield direct light from the lamp, the lamp 90 is often separated away from the hood and a vehicle body in order to prevent unnecessary discharge between the lamp and the hood or vehicle body. Furthermore, if a headlight system employs a halogen lamp as a light source and the lamp is desired to be replaced with a discharge lamp in order to improve the brightness of the headlight, the existing halogen lamp cannot be easily replaced with this type of discharge lamp.

In addition to this, there is another problem or characteristic in which a certain large size of this type of lamp system is typically used for attachment. Furthermore, such a conventional high pressure discharge lamp 90 may accidentally require an increased starting voltage due to gas leakage from the space between the arc tube 91 and the outer tube 92. Accordingly, excess or additional time for lighting up to a rated level may be required, or in worst cases, the lamp may not light up. Furthermore, such a discharge lamp has a conduction line located outside the outer tube, and therefore the starting voltage can be reduced without leakage.

SUMMARY

In view of the above-described and other characteristics and problems, an aspect of the presently disclosed subject matter includes a high pressure discharge lamp for use in a vehicle lighting device as a light source that can be efficiently used in place of a halogen lamp type device. It is another aspect of the presently disclosed subject matter to provide a discharge lamp which can be driven with a decreased starting voltage and to provide a lamp that can be as small as possible for both design and functional reasons.

Another aspect of the presently disclosed subject matter includes a high pressure discharge lamp including: an arc tube having a discharge space in which at least one rare gas is sealed, the arc tube including a pair of discharge electrodes projecting into the discharge space of the arc tube and located opposite to each other, and sealing portions located at respective ends of the arc tube, the sealing portions including at least one current feeding conductor configure to feed an electrical current to at least one of the discharge electrodes; an outer tube located adjacent the arc tube (or the outer tube surrounds the arc tube), the outer tube being hermetically sealed at opposite ends thereof to form a space between the arc tube and the outer tube (or the outer tube is sealed at the sealing portions of the arc tube), wherein the space between the arc tube and the outer tube includes a gas capable of dielectric barrier discharge; and a metal conductor located or configured along the arc tube and in the space, the metal conductor extending from one of the sealing portions and across an area adjacent the discharge space.

The high pressure discharge lamp as described above can further include a socket terminal, and one portion of the metal conductor can be connected to the current feeding conductor at a tip end side of the arc tube, another portion of the metal conductor being connected to the socket terminal, and the metal conductor not being exposed to an outside atmosphere (i.e., the metal conductor is contained within the outer tube) and also serving as a feeding line to the arc tube.

In the high pressure discharge lamp as configured above, the metal conductor can be composed of at least one of a linear and a plate-shaped metal material, and can be fixed at a welded portion at which the arc tube joins with the outer tube.

Alternatively, at least one of the sealing portions and the outer tube can be welded together to form a welded portion, and the metal conductor can be located at the welded portion. In this case, the metal conductor can be made of at least one of a linear and a plate-shaped metal material.

In the high pressure discharge lamp configured as described above, the metal conductor can be wound around a portion of the arc tube adjacent at least one of the discharge electrodes and at least one end of the metal conductor can be fixed to the arc tube.

In the high pressure discharge lamp configured as described above, the metal conductor can be configured as a light shielding cover located on an inner surface of the outer tube and configured to form a light distribution pattern during operation of the lamp.

In accordance with the presently disclosed subject matter, any portion to which a high voltage is applied should not be exposed from the discharge tube. Therefore the lamp system can be installed on a vehicle body with narrower separate space between lamps, thereby effectively reducing the size of this type of vehicle lamp system.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

Figure 1:
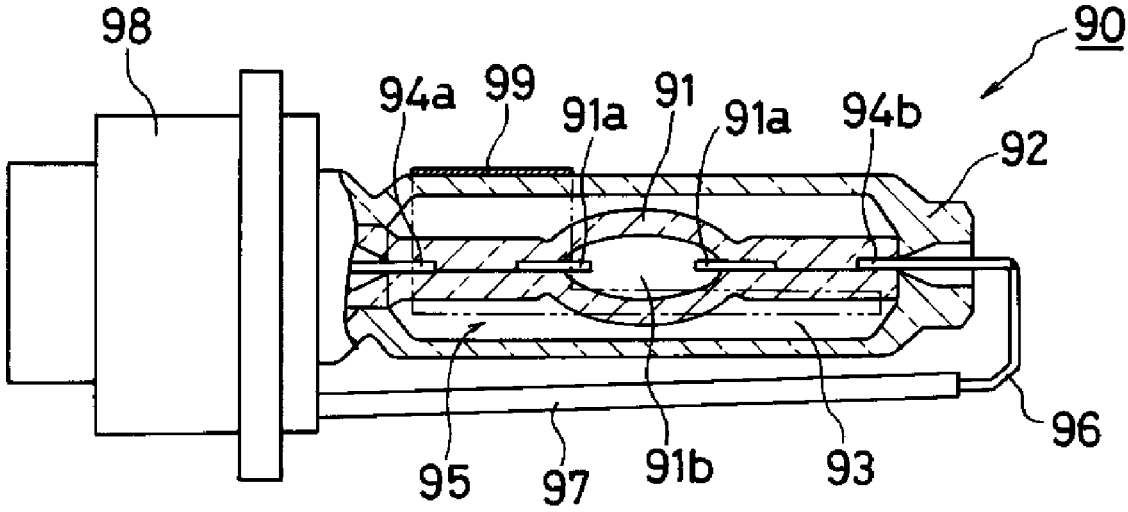
Fig. 1 Conventional Art
FIG. 1 is a cross sectional view showing a conventional discharge lamp.
Figure 2:
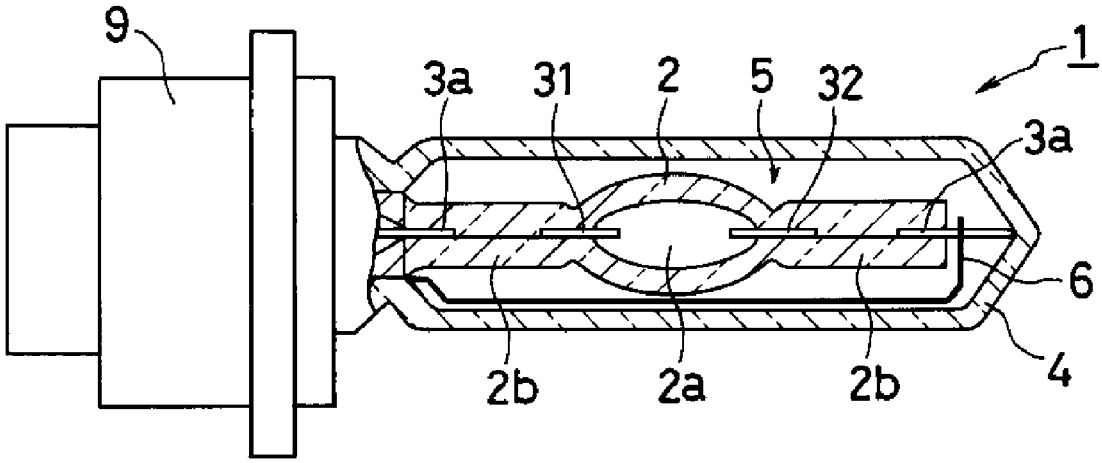
FIG. 2 is a cross sectional view showing an exemplary embodiment of a high pressure discharge lamp made in accordance with principles of the presently disclosed subject matter.

A description will now be given of exemplary embodiments in accordance with the presently disclosed subject matter with reference to the accompanying drawings. FIG. 2 shows an exemplary embodiment of a high pressure discharge lamp 1 made in accordance with principles of the presently disclosed subject matter. The high pressure discharge lamp 1 has an arc tube 2 that defines a discharge space 2*a* into which at least one kind of rare gas is sealed. A pair of discharge electrodes 31 and 32 project oppositely and are opposed with respect to each other within the discharge space 2*a* of the arc tube 2.

The arc tube 2 has a pair of sealing portions 2*b* extending from respective ends of the discharge space 2*a* of the arc tube 2 to hermetically seal the discharge space 2*a*. The paired discharge electrodes 31 and 32 are connected to respective current feeding conductors 3*a* which are embedded within the sealing portions 2*b*. Then, the current feeding conductors 3*a* project from their respective sealing portions 2*b* at an appropriate length.

An outer tube 4 surrounds the arc tube 2 including the sealing portions 2*b*. A gas 5 capable of dielectric barrier discharge is sealed in a space between the arc tube 2 and the outer tube 4. Within that space, a metal conductor 6 is provided and extends from at least one of the sealing portions 2*b* towards the discharge space 2*a*.

In the exemplary embodiment of FIG. 2, one end of the metal conductor 6 is connected to the current feeding conductor 3*a* to which the discharge electrode 32 is connected. The other end of the metal conductor 6 passes through the portion where the arc tube 2 (or the sealing portion 2*b*) and the outer tube 4 are welded, and is connected to a current feeding terminal (not shown) of a socket 9 which is different from that connected with the discharge electrode 31 (also not shown). Namely, in accordance with the present exemplary embodiment, the metal conductor 6 can serve as a lead line.

In this configuration, lead lines and/or ceramic pipes, which are conventionally exposed outside the outer tube 4, can be prevented from being exposed to the outside. The conductor 6 is enclosed within the inner space and therefore, no ceramic pipe is required. This can prevent any discharge occurring between the lamp and the hood, housing, or other vehicle body components (not shown). Since lead lines and ceramic pipes are not necessarily exposed to the outside, damage during replacement or repair, etc. due to inappropriate handling or the like can be prevented.

In addition, when a halogen lamp is used as a light source in a certain type of vehicle lighting system and is replaced with a discharge lamp, a design change is not necessarily required when replacing such an HID lamp. For example, when the same type of vehicle employs a lamp system that can use a halogen lamp or an HID lamp in accordance with a corresponding different grade, a housing dimension design can be shared with the different grade vehicles without any substantial modification.

In the exemplary embodiment of FIG. 2, even with the metal conductor 6 provided between the arc tube 2 and the outer tube 4, the action of gas 5 that is capable of dielectric barrier discharge, sealed in the space between the arc tube 2 and the outer tube 4, can still be provided. The present inventors have confirmed an experimental lamp that can be started with a reduced voltage.

The present inventors have found that the metal conductor 6 can provide a different effect from that described above. In some cases, an accidental increased starting voltage may be generated in this type of high pressure discharge lamp 1 and/or a crack can occur in the outer tube 4. This may cause the leakage of gas 5 capable of dielectric barrier discharge. However, in accordance with the presently disclosed subject matter, it has been found that a different effect can be provided in which a starting voltage may not increase too much.

Hereinafter, the different effect will be described with reference to another exemplary embodiment in which a lead line 7 and a ceramic pipe 8 are adapted for a high pressure discharge lamp in accordance with the presently disclosed subject matter.

Figure 3:
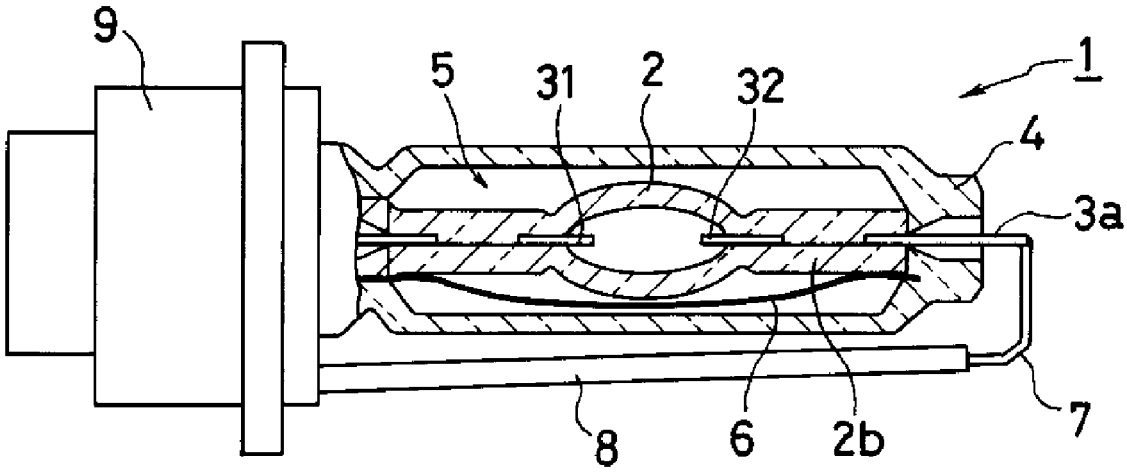
FIG. 3 is a cross sectional view showing another exemplary embodiment of a high pressure discharge lamp made in accordance with principles of the presently disclosed subject matter.

FIG. 3 shows another exemplary embodiment of the high pressure discharge lamp 1 in accordance with the presently disclosed subject matter. In this exemplary embodiment, during the manufacture of the discharge lamp, the arc tube 2 (or the sealing portion 2*b*) and the outer tube 4 sandwich a linear metal conductor 6 at respective ends and they are welded together to provide an integrated form where the metal conductor 6 extends across both ends. In this case, it is possible to use quartz glass, which has excellent weldability, in the area where the linear metal conductor 6 is welded. It should be noted that the metal conductor 6 may be fixed at any single side.

Figure 4:
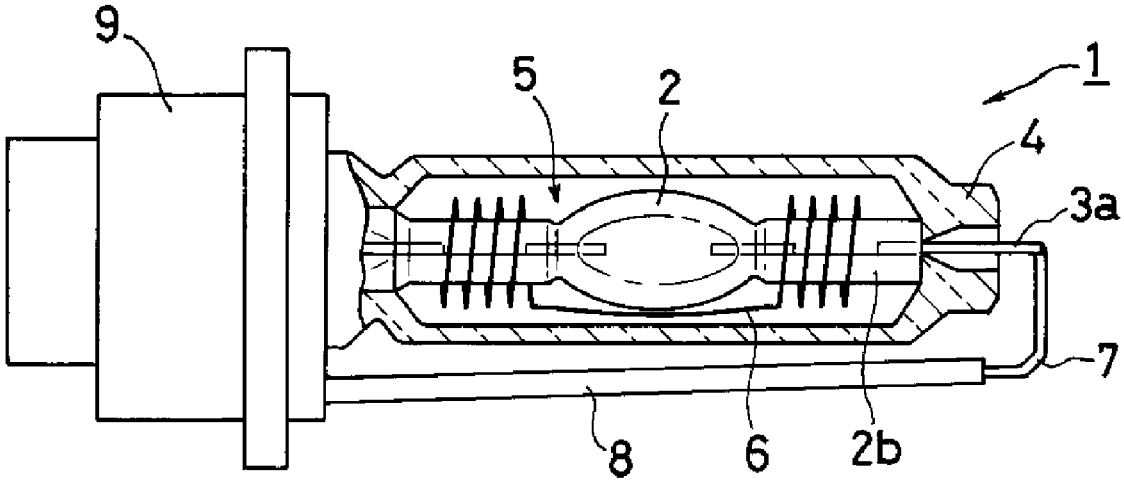
FIG. 4 is a cross sectional view showing still another exemplary embodiment of a high pressure discharge lamp made in accordance with principles of the presently disclosed subject matter.

FIG. 4 shows still another exemplary embodiment of a high pressure discharge lamp 1 made in accordance with principles of the presently disclosed subject matter. The present exemplary embodiment can facilitate the assembly of the lamp. In the previous exemplary embodiment, quartz glass and metal materials are welded together. In the present exemplary embodiment, for example, a linear metal conductor 6 is wound around one of the sealing portions 2*b* and then passes by the center region of the arc tube 2, and then is wound around the other of the sealing portions 2*b* and fixed. Note that the metal conductor 6 may be fixed at any one of the sides.

In this case, the assembly of lamp can be simplified because the arc tube 2 (or the sealing portion 2*b*) and the outer tube 4 may be welded, i.e., both glass materials are simply welded together to fix the metal conductor 6 in the present exemplary embodiment. This can also reliably prevent gas leakage.

Figure 5:
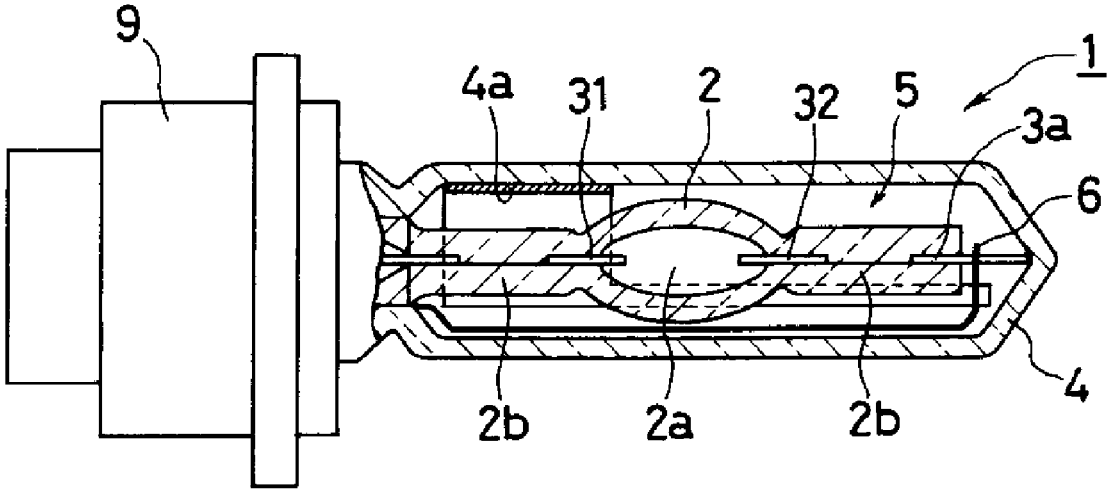
FIG. 5 is a cross sectional view showing yet another exemplary embodiment of a high pressure discharge lamp made in accordance with principles of the presently disclosed subject matter.

FIG. 5 shows still another exemplary embodiment of a high pressure discharge lamp 1 made in accordance with principles of the presently disclosed subject matter. Typical conventional metal halide discharge lamps for use in a vehicle can be provided with a light shielding cover on a predetermined area of the outer tube in order to provide a specific light distribution property.

In this case, a light shielding cover 4*a* can be formed of a metal subjected to surface treatment to have a black-colored surface, for example. This cover 4*a* is attached to a predetermined position on the outer tube 4. In this configuration, the light shielding cover 4*a* can serve as a metal conductor 6 for reducing the starting voltage for the high pressure discharge lamp 1 as well as function to provide a desired light distribution property (light shielding function). Furthermore, the light shielding cover 4*a* can be provided closer to the arc tube 2. This can allow a sharp cut of light to accurately shape the light distribution property. This exemplary embodiment can provide another effect in which a lead line 7 and/or a ceramic pipe 8 is/are not required.

As discussed above, a gas 5 capable of dielectric barrier discharge can be sealed in between the arc tube 2 and the outer tube 4, and this can reduce the starting voltage for the high pressure discharge lamp 1. Furthermore, a metal conductor 6 can serve as a lead line 7, and this can miniaturize the high pressure discharge lamp. For example, it is possible to share the housing of a headlight such that both a halogen lamp and a high pressure discharge lamp can serve as a light source in accordance with the vehicle grade.

Using a metal conductor 6 makes it possible to reduce light-up failure due to accidental increased starting voltage which occurs in this type of conventional high pressure discharge lamp as well as can prevent starting voltage increase due to leakage of the gas 5. Accordingly, the performance of this type of high pressure discharge lamp can be made more stable.

In the above-described exemplary embodiments, a metal conductor 6 is arranged in the space between the arc tube 2 and the outer tube 4, i.e., in the gas 5 capable of dielectric barrier discharge. Accordingly, the metal material may be selected from materials which are not oxidized in the gas 5 and/or cannot be melted by the heat generated during lighting-up. Examples of the metal material include, but are not limited to, Ni, Mo, and W in the case where the sealed gas is Ne, Ar, Kr, or Xe, and Pt in the case where the sealed gas is $F_2$, $Cl_2$, $Br_2$, $I_2$ or $N_2$.

While there has been described what are at present considered to be exemplary embodiments of the invention, it will be understood that various modifications may be made thereto, and it is intended that the appended claims cover such modifications as fall within the true spirit and scope of the invention.

What is claimed is:

1. A high pressure discharge lamp comprising:

an arc tube having a discharge space in which at least one rare gas is located, the arc tube including a pair of discharge electrodes projecting into the discharge space of the arc tube and located opposite to each other, and sealing portions located at respective ends of the arc tube, the sealing portions including at least one current feeding conductor that feeds an electrical current to at least one of the discharge electrodes;

an outer tube located adjacent the arc tube, the outer tube being hermetically sealed at opposite ends thereof to form a space between the arc tube and the outer tube, wherein the space between the arc tube and the outer tube includes a gas that produces a dielectric barrier discharge; and a metal conductor located along the arc tube and in the space, the metal conductor extending from one of the sealing portions and across an area adjacent the discharge space.

2. The high pressure discharge lamp according to claim 1, further comprising:

a socket terminal, wherein one portion of the metal conductor is connected to the current feeding conductor at a tip end side of the arc tube, another portion of the metal conductor is connected to the socket terminal, and the metal conductor is contained within the outer tube and serves as a feeding line to the arc tube.

3. The high pressure discharge lamp according to claim 1, wherein the metal conductor is composed of at least one of a linear and a plate-shaped metal material, and is fixed at a welded portion at which the arc tube joins with the outer tube.

4. The high pressure discharge lamp according to claim 1, wherein at least one of the sealing portions and the outer tube are welded together to form a welded portion, and the metal conductor is located at the welded portion.

5. The high pressure discharge lamp according to claim 4, wherein the metal conductor is made of at least one of a linear and a plate-shaped metal material.

6. The high pressure discharge lamp according to claim 1, wherein the metal conductor is wound around a portion of the arc tube adjacent at least one of the discharge electrodes, and at least one end of the metal conductor is fixed to the arc tube.

7. The high pressure discharge lamp according to claim 1, wherein the metal conductor is configured as a light shielding cover located on an inner surface of the outer tube and configured to form a light distribution pattern during operation of the lamp.

8. The high pressure discharge lamp according to claim 2, wherein the metal conductor is configured as a light shielding cover located on an inner surface of the outer tube and configured to form a light distribution pattern during operation of the lamp.

9. The high pressure discharge lamp according to claim 3, wherein the metal conductor is configured as a light shielding cover located on an inner surface of the outer tube and configured to form a light distribution pattern during operation of the lamp.

10. The high pressure discharge lamp according to claim 4, wherein the metal conductor is configured as a light shielding cover located on an inner surface of the outer tube and configured to form a light distribution pattern during operation of the lamp.

11. The high pressure discharge lamp according to claim 1, wherein the outer tube surrounds the arc tube.

12. The high pressure discharge lamp according to claim 1, wherein the outer tube is sealed at the sealing portions of the arc tube.

13. The high pressure discharge lamp according to claim 1, further comprising:

a socket terminal, wherein one end of the metal conductor is connected to the current feeding conductor at a tip end side of the arc tube, and an opposite end of the metal conductor is connected to the socket terminal.

14. The high pressure discharge lamp according to claim 1, wherein the sealing portions and the outer tube are welded together to form welded portions, and the metal conductor is located at least one of the welded portions.

15. A high pressure discharge lamp comprising:

an arc tube having a longitudinal axis and a discharge space in which at least one rare gas is located, the arc tube including a pair of discharge electrodes projecting into the discharge space, and sealing portions located at respective ends of the arc tube, at least one of the sealing portions including at least one current feeding conductor that feeds an electrical current to at least one of the discharge electrodes;

an outer tube located adjacent the arc tube, the outer tube being sealed at opposite ends thereof to form a space between the arc tube and the outer tube, wherein the space between the arc tube and the outer tube includes a gas that produces a dielectric barrier discharge; and a metal conductor located in the space adjacent the arc tube, the metal conductor extending from a first location that intersects an imaginary line perpendicularly extending from the longitudinal axis of the arc tube located at one of the sealing portions, to a second location that intersects a second imaginary line perpendicularly extending from the longitudinal axis of the arc tube located at another of the sealing portions.

16. The high pressure discharge lamp according to claim 15, further comprising:

a socket terminal connected to one end of the metal conductor, wherein another end of the metal conductor is connected to the current feeding conductor at a tip end side of the arc tube, and the metal conductor is sealed within the outer tube and serves as a feeding line to the arc tube.

17. The high pressure discharge lamp according to claim 15, wherein the metal conductor is composed of at least one of a linear and a plate-shaped metal material, and is fixed at a welded portion at which the arc tube joins with the outer tube.

18. The high pressure discharge lamp according to claim 15, wherein at least one of the sealing portions and the outer tube are welded together to form a welded portion, and the metal conductor is located at the welded portion.

19. The high pressure discharge lamp according to claim 18, wherein the metal conductor is made of at least one of a linear and a plate-shaped metal material.

20. The high pressure discharge lamp according to claim 15, wherein the metal conductor is wound around a portion of the arc tube adjacent at least one of the discharge electrodes, and at least one end of the metal conductor is fixed to the arc tube.

21. The high pressure discharge lamp according to claim 15, wherein the metal conductor is configured as a light shielding cover located on an inner surface of the outer tube and forms a light distribution pattern during operation of the lamp.

22. The high pressure discharge lamp according to claim 16, wherein the metal conductor is configured as a light shielding cover located on an inner surface of the outer tube and forms a light distribution pattern during operation of the lamp.

* * * * *